US005155526A

United States Patent [19]

Kawabata

[11] Patent Number: 5,155,526

[45] Date of Patent: Oct. 13, 1992

[54] ELECTROPHOTOGRAPHIC COPYING APPARATUS HAVING AXIALLY ALIGNED DEVELOPING ELEMENTS

[75] Inventor: Hidetoshi Kawabata, Osaka, Japan

[73] Assignee: Minolta Camera Kabushiki Kaisha, Osaka, Japan

[21] Appl. No.: 376,021

[22] Filed: Jul. 6, 1989

[30] Foreign Application Priority Data

Jul. 7, 1988 [JP] Japan ..... 63-170492
Jul. 7, 1988 [JP] Japan ..... 63-170497
Jul. 7, 1988 [JP] Japan ..... 63-170499

[51] Int. Cl.[5] ..... G03G 15/00

[52] U.S. Cl. ..... 355/200; 355/212; 355/229

[58] Field of Search ..... 355/211, 212, 219, 234, 355/299, 200, 202, 229, 228, 235

[56] References Cited

U.S. PATENT DOCUMENTS 4,360,262 11/1982 Genthe ..... 355/219
4,556,308 12/1985 Hoppner et al. ..... 355/212 X
4,696,562 9/1987 Urata et al. ..... 355/202
4,702,591 10/1987 Tsuda et al. ..... 355/299
4,803,517 2/1989 Bruce, Jr. ..... 355/202
4,806,967 2/1989 Newbury ..... 355/210
4,857 956 8/1989 Honda ..... 355/234
5,062,003 10/1991 Kawabata ..... 355/202 X

FOREIGN PATENT DOCUMENTS 50-85340 7/1975 Japan .
51-146237 12/1976 Japan .
51-147327 12/1976 Japan .

*Primary Examiner*—A. T. Grimley
*Assistant Examiner*—Christopher Horgan
*Attorney, Agent, or Firm*—Burns, Doane, Swecker & Mathis

[57] ABSTRACT

A fixing unit and a developing unit are oppositely positioned in alignment in the longitudinal direction of a photoconductor which is flatly stretched on an endless belt. The photoconductor is more flatly stretched between the fixing unit and the developing unit than these units so that it is housed therein leaving spaces for disposing other required image forming devices. A charger which is one of the other image forming devices acts to charge the photoconductor and also to transfer a toner image on the photoconductor onto a sheet of copy paper.

25 Claims, 6 Drawing Sheets

ELECTROPHOTOGRAPHIC COPYING APPARATUS HAVING AXIALLY ALIGNED DEVELOPING ELEMENTS

BACKGROUND OF THE INVENTION

1. Field of the Invention

The present invention relates to an electrophotographic copying apparatus, and more particularly to a small-sized copying apparatus suitable for personal use.

2. Description of Related Art

Heretofore, various kinds of this type of copying machines have been proposed and put on the market. Most of the machines are, as shown in FIG. 1, provided with an exposure optical system b above a photoconductive drum a and a transfer charger c under the photoconductive drum a. Around the photoconductive drum a, a developing unit d, a cleaner e, an eraser f and a charger g are disposed with exposure space h, and the diameter of the photoconductive drum a is set (for instance, about 30 mm) as small as possible in order to be able to accommodate these devices.

Under such constructional arrangement, a transport path i of transfer materials which receive transfer process is formed conforming to the level of a transfer section positioned between the photoconductive drum a and the transfer charger c arranged under the photoconductive drum, and a fixing unit j is disposed at the terminal of the path i. A conventional copying machine of this type can be manufactured small and thin by making diameter of the photoconductive drum a as small as possible.

However, it is necessary for the photoconductive drum a to have a diameter which can provide sufficient circumferential length for disposing aforementioned various image forming devices since various image forming devices including the exposure optical system b are disposed only in the same conventional manner. Accordingly, there is a limit in manufacturing the photoconductive drum a in small size.

Furthermore, the image forming devices are bulky around the photoconductive drum a thereby causing the space of image forming section largely expanded. Under such arrangement, the fixing unit j expands more than the space of image forming section downwardly. Because of the reasons as mentioned above, sufficiently thin copying machine has not been introduced yet.

In order to reduce the number of image forming devices, it may be considered to perform one round of copying operation by properly using one charger as charger and transfer unit when the photoconductive drum a makes two cycles of rotations. However, the photoconductive drum a needs a circumferential length to cover the size for enabling copying operation, and therefore, the diameter of the photoconductive drum a needs to be, for instance, approximately 100 mm when A4 size paper is used for copying thus making the photoconductive drum more larger in size.

In the meantime, there is known a small-sized copying machine provided with a belt-shape photoconductor, in which the photoconductor is horizontally stretched so that image forming devices can be disposed without increasing size of the space at the locations above and below the photoconductor. However, there is no special consideration given to the arrangement of image forming devices and fixing unit, and consequently, the machine has not been manufactured sufficiently thin.

SUMMARY OF THE INVENTION

A main object of the present invention is to provide an electrophotographic copying apparatus which can be manufactured sufficiently thin by proper selection of image forming process coordinated with a skillful arrangement of image forming devices.

Another object of the present invention is to provide an electrophotographic copying apparatus which can be manufactured sufficiently thin by reducing one of image forming devices with adoption of an image forming process wherein one charger is properly used as charger and transfer unit for performing one round of copying operation when an endless-belt shape photoconductor makes two cycles of rotations, and also by disposing a developing unit and a fixing unit in alignment oppositely on both ends in the longitudinal direction of the endless-belt shape photoconductor which is stretched more flatly than the developing unit and the fixing unit where the photoconductor is housed leaving sufficient space to accommodate other necessary image forming devices therein so that all the devices are housed within the heights of the developing unit and the fixing unit.

Further object of the present invention is to provide an electrophotographic copying apparatus wherein a cleaning member is arranged close to a developing unit immediately downstream of rotative direction of the endless-belt shape photoconductor and the cleaning member acts on the photoconductor at almost the same position of the developing unit.

Still further object of the present invention is to provide an electrophotographic copying apparatus capable of substantially reducing the number of troublesome devices which are dealt with toner by incorporating a cleaning member with a developing unit.

These and other objects and features of the present invention will become more apparent from the following description taken in conjunction with the preferred embodiments thereof with reference to the accompanying drawings.

DESCRIPTION OF THE PREFERRED EMBODIMENT

An embodiment of the present invention will be described below referring to the accompanying drawings, FIGS. 2 through 8.

Figure 1:
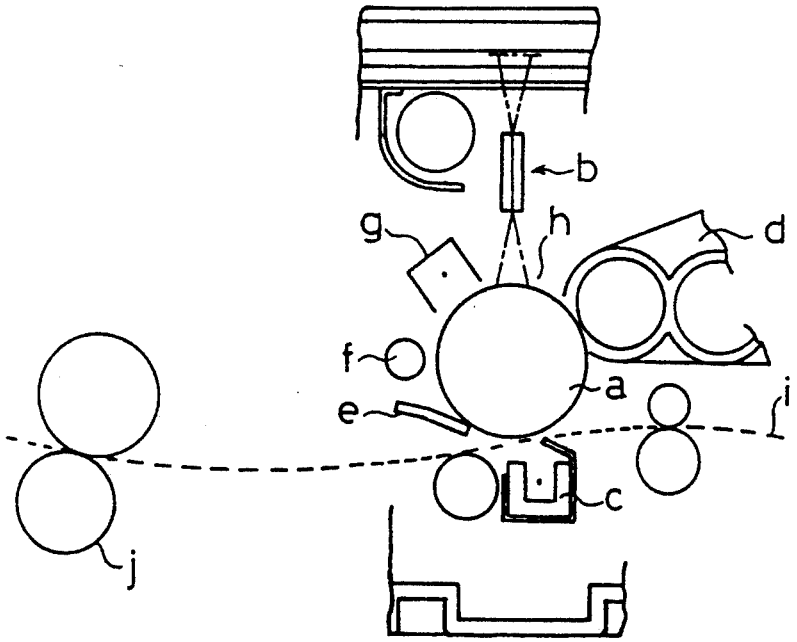
Fig.1 PRIOR ART
FIG. 1 is a constructional view showing an example of a part of conventional original table transport type electrophotographic copying apparatus.
Figure 2:
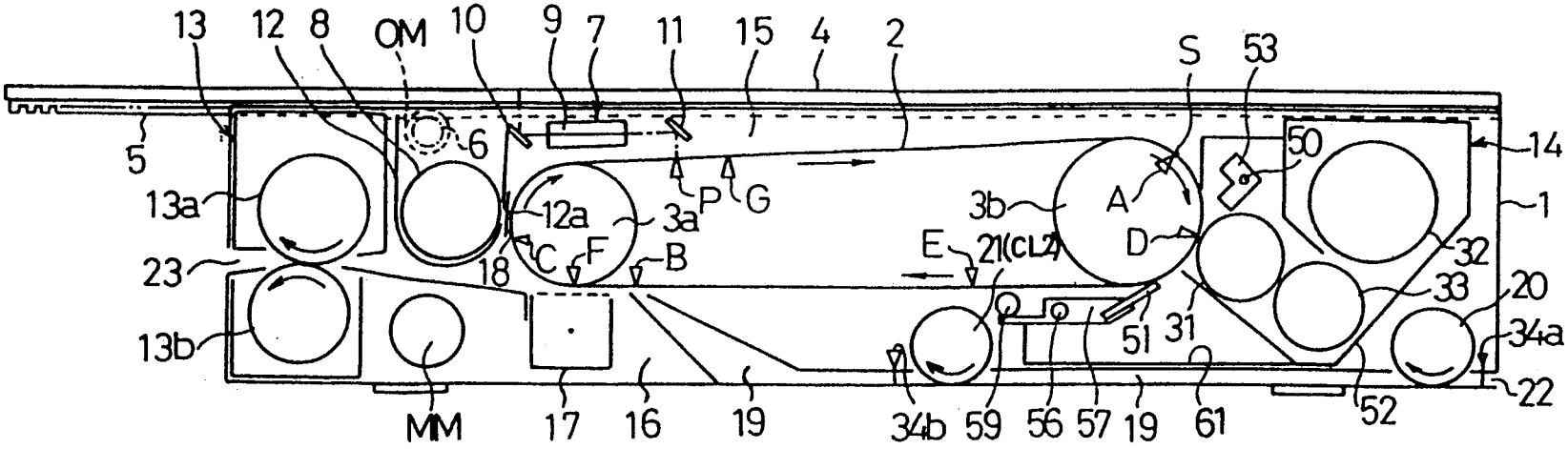
FIG. 2 is a schematic constructional view illustrating an embodiment of an original table transport type electrophotographic copying machine to which the present invention is applied.

FIG. 2 shows a flat and small-sized original table transport type electrophotographic copying apparatus to which the present invention is applied.

As illustrated in FIG. 2, the apparatus is provided with a flat body 1 which is long sideways in section. At about the central portion of the body 1, there is provided an endless-belt shape photoconductor 2. The endless-belt shape photoconductor 2 is flatly stretched along longitudinal direction of said section of the body 1 by a driven roller 3*a* and a driving roller 3*b* arranged on both sides of the photoconductor.

A movable original table 4 is provided on the body 1. The original table 4 is moved by drive of a pinion 6 arranged on the body which engages with a rack 5 on the original table 4.

An image of original placed on the original table 4 is arranged to be exposed through a slit onto the endless-belt shape photoconductor 2 by an exposure optical system 7 provided under the original table 4 in the body 1. The exposure optical system 7 comprises a lamp 8 for illuminating the original, a convergent light transmitting member 9 for projecting the illuminated image of original onto the endless-belt shape photoconductor 2, and mirrors 10,11 for folding the projecting light path.

The lamp 8 is accommodated within a housing 12 by which the light is collected at a predetermined position and which is disposed immediately on the left side of the photoconductor 2. The light transmitting member 9 is made of a multi-lens type or fiber type and is laid immediately above and left side of the endless-belt shape photoconductor 2.

The mirror 10 is arranged on the left side of the light transmitting member 9 to lead the light from an original to the light transmitting member 9, while the mirror 11 is provided on the right side of the light transmitting member 9 to lead the light emitted from the light transmitting member 9 onto the endless belt-shape photoconductor 2.

The exposure optical system 7 thus arranged is housed compactly on the left side of the endless-belt shape photoconductor 2 in FIG. 2 and along the upper portion of the photoconductor. Consequently, the expansion above the photoconductor 2 is specially reduced.

Figure 3:
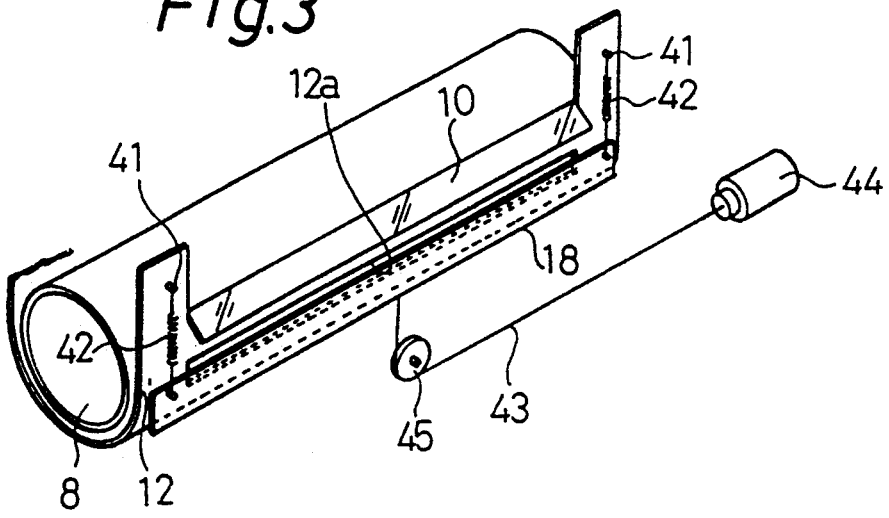
FIG. 3 is a perspective view of a shutter mechanism provided at a light source section.

As illustrated in FIGS. 2 and 3, a light throwing slit 12*a* is arranged in the section of the housing 12 opposite to the endless-belt shape photoconductor 2. The light throwing slit 12*a* is provided for directly throwing the light of the lamp 8 onto the photoconductor 2 for erasing, by which an erasing means can be omitted. The light throwing slit 12*a* is provided with a shutter 18 to shut the light throwing slit 12*a* at least during an image exposure process in order not to obstruct the image exposure operation.

Accordingly, as shown in FIG. 3, the upper edge on both ends of the shutter 18 are connected with the housing 12 by pins 41,41 provided on walls of both ends of the housing 12 through springs 42,42, while the lower edge in the central portion is connected to a solenoid 44 fixed to the outer surface of the inner side plate in the body 1 through a wire 43 which is bent 90° in a midway point by a pulley 45.

The shutter 18 is thus held in harmony with the solenoid 44 and pins 41,41, and when the solenoid 44 is turned off, the shutter 18 is pulled up to the upper movement position by a spring 42 to shut the light throwing slit 12*a*, while when the solenoid 44 is turned on, the shutter 18 is moved downward resisting the spring 42 to open the light throwing slit 12*a*.

A fixing unit 13 is arranged immediately on the left side of the lamp 8 which is positioned on the left side of the endless-belt shape photoconductor (when viewing FIG. 2), while a developing unit 14 is arranged immediately on the right side of the endless-belt shape photoconductor 2. The fixing unit 13 and the developing unit 14 are formed in almost the same height and are laterally arranged in almost the same alignment with the endless-belt shape photoconductor 2. Both the upper and lower surfaces of the fixing unit 13 are arranged to face along the upper and lower surface plates of the body 1, and the upper surface of the developing unit 14 is arranged to face along the upper surface plate of the body 1.

The endless-belt shape photoconductor 2 is stretched more flatly than the fixing unit 13 and the developing unit 14, and there is formed a laterally long upper space 15 between the original table 4 and a laterally long lower space 16 between the bottom of the body 1.

The upper space 15 is utilized for disposing the light throwing member 9 and the mirrors 10,11 on both sides of the light throwing member. In the lower space 16, there is provided a cleaner 51 and a charger 17 which is used as a charger and a transfer unit when the endless-belt shape photoconductor 2 makes two cycles of rotations clockwise as shown by arrow in FIG. 2.

The cleaner 51 is positioned immediately downstream in the rotative direction of the endless-belt shape photoconductor 2 relative to the developing unit 14 as shown in FIG. 2, and is incorporatively held with a casing 52 of the developing unit 14.

Figure 4:
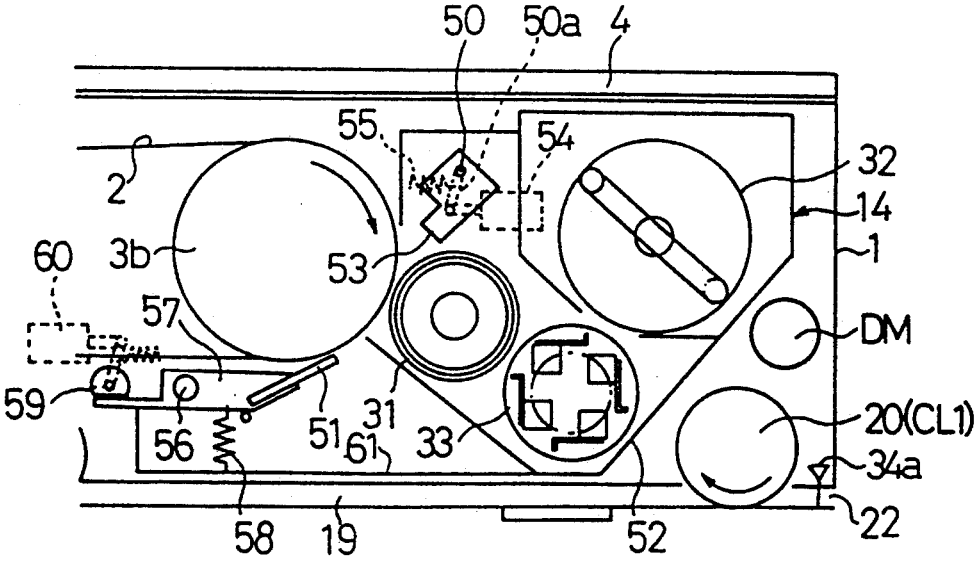
FIGS. 4 and 5 are partially enlarged views of a copying apparatus showing the condition of a developing unit at the time of developing process and the condition of a cleaner when cleaning is carried out.
Figure 5:
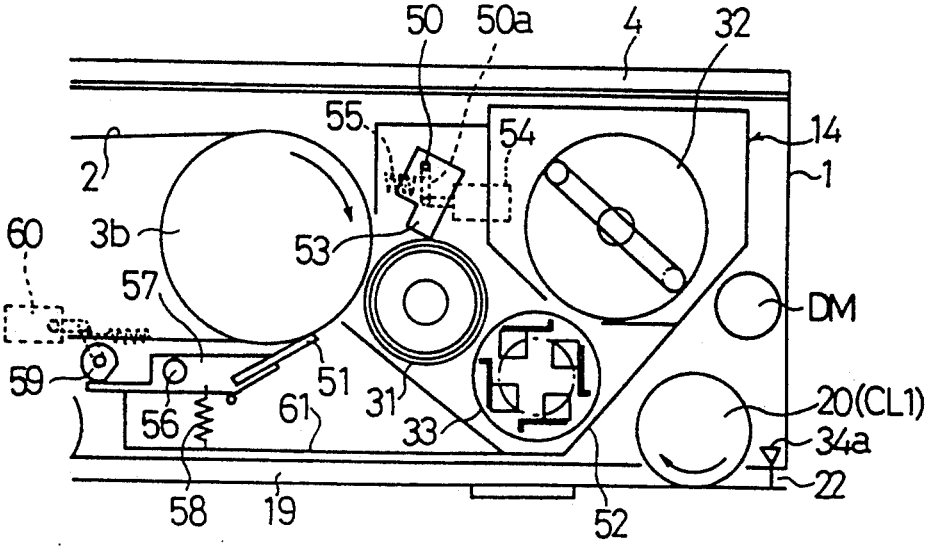

The developing unit 14 is provided, as shown in FIGS. 2,4 and 5, with a developing roller 31 arranged adjacent to the endless-belt shape photoconductor 2 with a proper gap therebetween, a transport roller 33 for supplying developer to the developing roller 31 by stirring and electrifying the developer in circulative transport and a member 32 for supplying toner to the transport roller 33. The developing roller 31 absorbs the developer fed thereto and transports the developer to the section opposite to the endless-belt shape photoconductor 2 by rotation.

The developer being transported by the developing roller 31 is further stirred and electrified by the magnetic field made by the magnetic pole of an unillustrated magnet member provided in the developing roller 31, and at the same time, forms an ear of the developer by one of the magnetic poles at the section facing the endless-belt shape photoconductor 2. When the ear of the developer comes into contact with the surface of the endless-belt shape photoconductor 2, toner is electrically attracted to an electrostatic latent image formed on the surface of the photoconductor to develop the electrostatic latent image.

In the developing unit 14, there is provided a developer scraping member 53 movably supported by a shaft 50 toward and away from the developing roller 31. The scraping member 53 is connected to a solenoid 54 which is attached to outer surface of an inner plate in the developing unit 14 through the shaft 50 and a passive arm 50*a* as shown in FIGS. 4 and 5, and at the same time, a restoring spring 55 is set to work.

Accordingly, the scraping member 53 is separated from the developing roller 31 by the spring 55 when the solenoid 54 is turned off and the development is not impaired by the developing roller 31.

On the other hand, when the solenoid 54 is turned on, the scraping member 53 is pressed to contact the developing roller 31 against the spring 55 so that the developer on the developing roller 31 is scraped off and the circumferential surface of the developing roller after it is cleaned is faced to the endless-belt shape photoconductor 2. Consequently, when developing operation is not performed, the ear of developer contact the endless-belt shape photoconductor 2 to prevent foreign matters such as paper dust stuck to the surface of the photoconductor 2 from rolling into the developing unit 14. It is, therefore, sufficient to carry out developer scraping operation for only a short while after the developing unit 14 has finished its developing operation.

The above description has been made for the case when two components developer consisted of magnetic carrier and toner is used, however, one component developer may be used.

The developing unit 14 is arranged to be taken in and out of the body 1 with the casing 52 in which the cleaner 51 is also accommodated so that they can be handled as one unit.

The cleaner 51 is attached to the point of a lever 57 pivotally supported by a shaft 56. The lever 57 is pressed to contact a cam shaft 59 by a spring 58. When the cam shaft 59 faces the direction as shown in FIG. 4 with a solenoid 60 turned off, the lever 57 is released from pressing action, and consequently the cleaner 51 is moved away from the endless-belt shape photoconductor 2 by the spring 58. Under such state, the visual image formed on the endless-belt shape photoconductor 2 is not damaged, and the cleaner 51 does not impair the endless-belt shape photoconductor 2 when the developing unit 14 is taken in and out of the body 1.

When the cam shaft 59 faces the direction as shown in FIG. 5 with the solenoid 60 turned on, the lever 57 is pressed a little against the spring 58 from the position shown in FIG. 5, and the cleaner is pressed to contact the endless-belt shape photoconductor 2 to enable the cleaning of the photoconductor 2. The solenoid 60 is also attached to the outer surface of an inner side plate in the body 1. The toner scraped off by the cleaner 51 drops into a toner receiver 61 formed in a part of the casing 52. Thus, the developing unit 14 and the cleaner 51 can be readily handled as one unit, and the problem of toner overflowing is substantially reduced.

It may also be possible to carry out cleaning operation by providing the developing unit 14 with a function of the cleaner 51 by temporarily raising a developing bias voltage to be impressed to the developing roller higher than the surface voltage of the endless-belt shaper photoconductor 2. In this case, the cleaner 51 shown in FIG. 2 is not necessary and thus the apparatus can be manufactured more lighter in weight and smaller in size since the developing unit is only required.

The image forming apparatus can thus be simplified by utilizing the charger 17 as a charger and a transfer unit. The cleaning of the endless-belt shape photoconductor can be fully conducted by the cleaner 51 without relying on the developing unit. Moreover, the cleaner 51 is provided immediately downstream of the developing unit in the rotative direction of the endless-belt shape photoconductor, and it acts on the photoconductor 2 at almost the same position as that of the developing unit 14. At the same time, when developing operation by the developing unit 14 is finished, the cleaning operation can be immediately started from the portion immediately after the section where image is formed by switching over to a cleaning operation so that the time lag between image forming operation and cleaning operation can be minimized to almost none.

By utilizing the space between the lower board of the body 1 and the lower board of the developing unit 14, there is formed a paper feed path 19 wherein a sheet of paper is fed to a transfer section and to a fixing section by the charger 17. In the midway points of the paper feed path 19, transport rollers 20,21 are provided at proper locations not to interfere with any other device. The reference numeral 22 designates a paper feed inlet and 23 a paper discharge outlet respectively.

A copying operation will now be described below. An original is first placed on an original table 4. Then, a sheet of copy paper is manually inserted from the paper feed inlet 22, by which a switch 34*a* is turned on to drive the transport rollers 20,21 for transporting the copy paper into the paper feed path 19.

By turning on the switch 34*a*, an unillustrated main motor is rotated to drive the endless-belt shaper photoconductor 2, the original table 4 and the fixing unit 13, and at the same time, the lamp 8 is turned on. The first movement by the driving of the original table 4 takes place as a returning action to a scan starting position. When the copy sheet has reached the switch 34*b* and turned it on, the transport rollers 20,21 are turned off and the copy sheet is held thereat for next operation.

By turning on the switch 34*b*, the charger 17 is also turned on to start for charging the endless-belt shape photoconductor 2, and before the electrified portion reaches the position of the light throwing slit 12*a*, the shutter 18 is closed, by which the electrified portion is remained ready for next exposure process.

On the other hand, the direction of movement of the original table 4 is changed from return to scan direction so as to have exposure on the front end of the original simultaneously with the timing the electrified portion of the endless-belt shape photoconductor 2 reaches the exposure position. The original on the original table 4 is thus successively exposed onto the endless-belt shape photoconductor 2 from the front end of the original.

The developing unit 14 is driven immediately before the front end of exposed portion of the original reaches the developing section. Thus, when the endless-belt shape photoconductor 2 which has finished developing process reaches immediately before the cleaner 51, the cleaner 51 is moved away from the photoconductor 2. Then, the transport roller 20,21 start rotation in synchronization with the front end portion of a visual image and the front end of the copy sheet meet each other. Thereafter, the copy sheet reaches the charger 17 in a manner to have the visual image coincide with the front end of the copy paper on the moving endless-belt shape photoconductor 2. At this stage, the charger 17 acts as a transfer charger, and a visual image on the endless-belt shape photoconductor 2 is transferred onto the copy sheet.

The copy sheet after transfer is separated from the endless-belt shape photoconductor 2 and then forwarded into the fixing unit 13. The visual image transferred onto the copy sheet is fixed by the fixing rollers 13*a*,13*b* and discharged onto the discharge outlet 23.

On the other hand, the shutter 18 is opened at the time when the rear end of the original which is exposed on the endless-belt shape photoconductor 2 is not affected by light thrown from the light throwing slit 12*a*. The residual electric charge on the endless-belt shape photoconductor 2 after transfer is thus erased. The cleaner 51 is pressed to contact the photoconductor 2 at a predetermined timing after the developing unit 14 has finished the developing process to clean the photoconductor, while the developing roller 31 receives an action by the scraping member 53 for a predetermined period of time after developing process.

Figure 6:
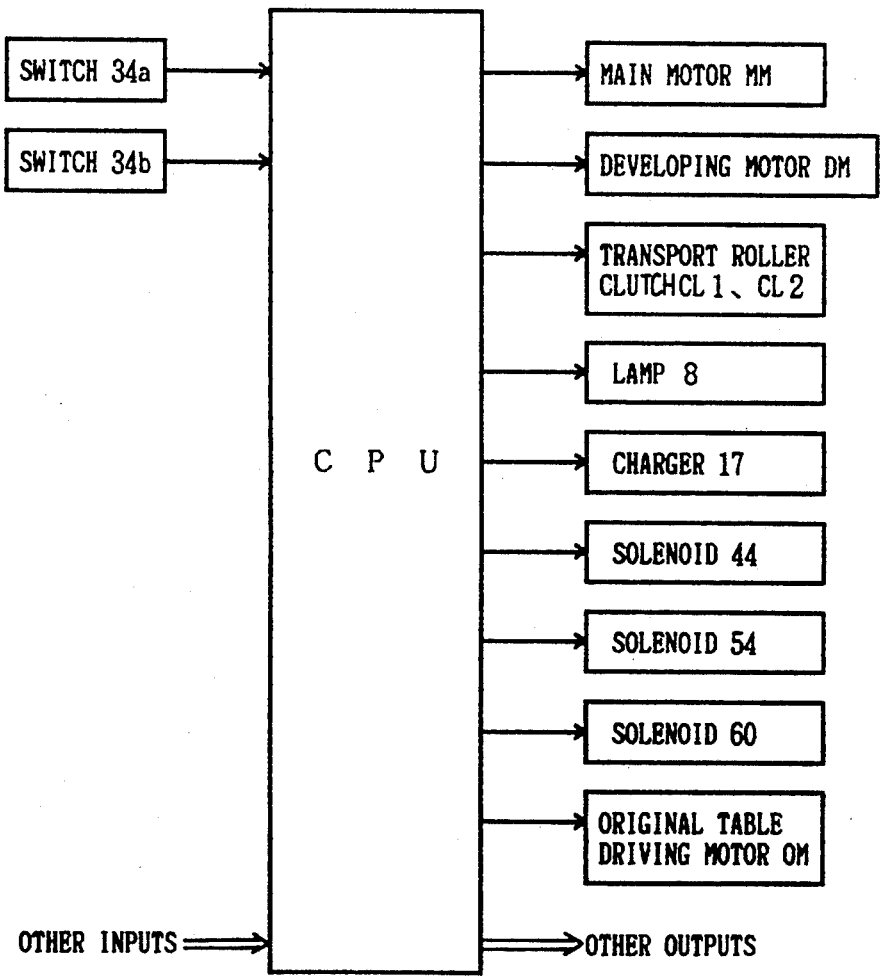
FIG. 6 is a block diagram of a control circuit.

The above operational control is conducted by the CPU 100 shown in FIG. 6. The switches 34*a*,34*b* are connected to the CPU on its input side, while a main motor MM for driving the endless-belt shape photoconductor 2, fixing unit 13, transport rollers 20,21 and the like, a developing motor DM for driving the developing unit 14, an original scan motor OM for driving the original table 4, clutches CL1,CL2 for properly turning on and off the transport rollers 20,21, operational solenoids 44,54 and 60 and the like for the lamp 8, charger 17, shutter 18, developer scraping member 53 and cleaner 51 are connected with the CPU on its output side.

Figure 7:
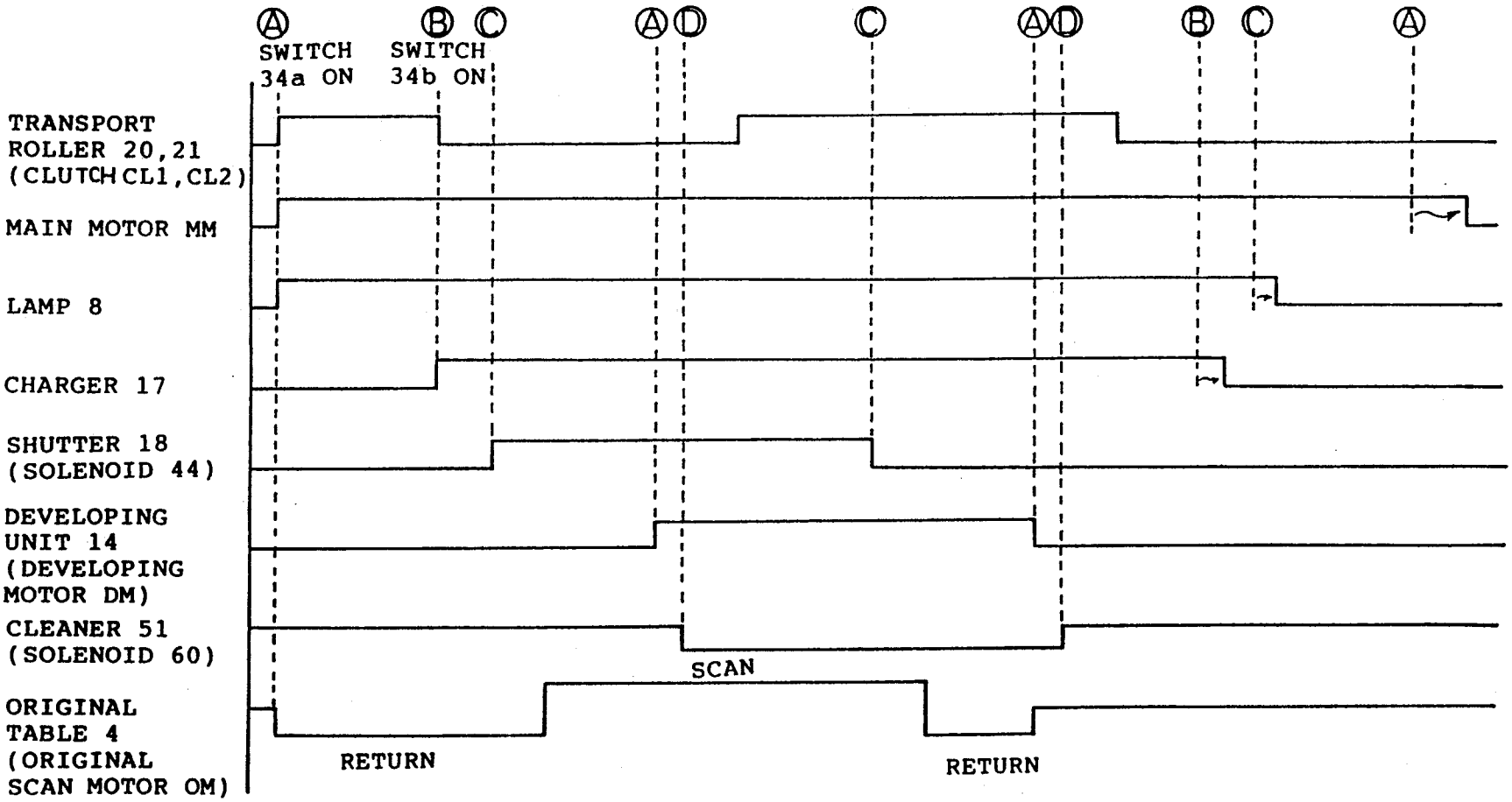
FIG. 7 is a time chart showing the actions of main devices.
Figure 8:
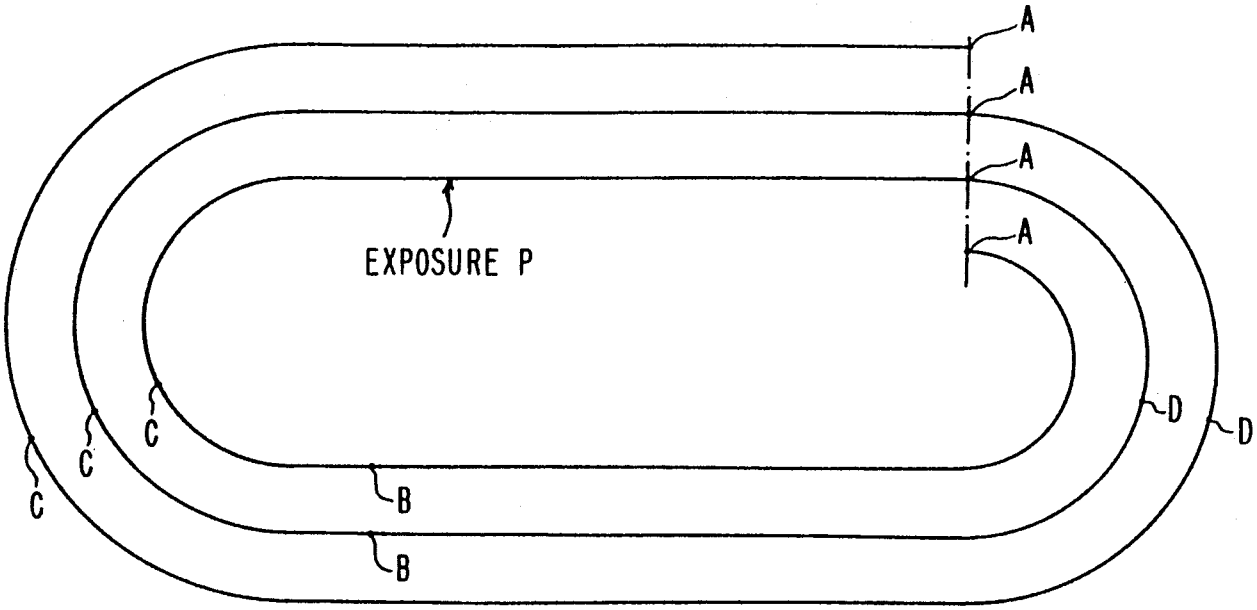
FIG. 8 is a diagrammatic view falsely showing a locus of movement at a starting point of image forming operation of a belt shape photoconductor.

FIG. 7 shows a time chart of the above main operation. By utilizing the time chart, the timing of each action will now be described in detail basing on the false diagrammatic view of moving locus at the image formation starting point of the endless-belt shape photoconductor in FIGS. 2 and 8.

When the original table 4 is returned by the distance of 20 cm with the switch 34*a* turned on, the point A which is 20 cm upstream from the exposure position P in FIG. 2 becomes he starting point for image forming operation. Accordingly, when the copy starting position S of the photoconductor 2 which is on the point A is reached immediately before the upstream of the charger 17, in other words, when the copy paper is forwarded and reached the point B adjacent to the position where the copy paper and the photoconductor 2 come in contact with each other, the charger 17 is turned on, by which electrification on the portion beyond the image forming point S can be surely accomplished.

When the S point of of the photoconductor 2 which reached the point B is further moved and reached point C, the shutter 18 is turned off, by which light throwing from the light throwing slit 12*a* is prevented from erasing the electrification.

When the S point has made one round of rotation and reached the A point, the developing unit 14 starts its action, and when it further proceeded to D point, the cleaner 51 is moved away from the endless-belt shape photoconductor 2. When the S point is reached E point where the S point coincides with the front end of the copy sheet in the transport rollers 20,21, the transport rollers 20,21 are rotated to start feeding copy paper. Thereafter, a visual image is transferred onto the copy paper at transfer position F, and the paper is separated from the endless-belt shape photoconductor to proceed to the fixing unit 13.

On the other hand, when the point S is reached the C point, the shutter 18 is opened to start erasing operation, and when the point S is reached the A point, the action by the developing unit 14 is finished. After the point S is reached the D point, cleaning operation is started, and the photoconductor 2 is driven until the copy paper is discharged out of the body 1. Accordingly, when the point S is reached point G, the main motor is stopped and all action are suspended. As a matter of course, it may be arranged to stop only the driving of the photoconductor at the time when transfer operation is finished.

In summary, in a first circulation of A-B-C-A in FIG. 7, electrification on the endless-belt shape photoconductor 2 required for a complete circulation and a part of exposure are performed, and in a second circulation of A-D-B-C-A, the remaining exposure and developing and transfer operation are conducted to complete a copying operation. Further, as a final treatment of the endless-belt shape photoconductor 2, in a third circulation of A-D-B-C-A, erasing of the photoconductor 2 for the complete circulation and cleaning are performed.

When the developing unit 14 is not in developing action, it may be arranged to retreat the developing unit 14 itself in order to prevent the ears of toner of the magnetic brush on the developing roller 31, from getting into contact with the photoconductor 2 besides the embodiments described above.

It may also be arranged to control the direction of the magnetic member so as not to have magnet pole of the developing roller 31 faced to the endless-shape photoconductor 2.

In the above embodiment, an original table moving type apparatus has been described, however, it may also be applicable to the type of apparatus wherein scanning exposure is carried out by transporting an original by use of rollers or the like.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic copying apparatus for copying an image of an original on a copy paper, comprising:

an endless-belt shape photoconductor which is driven in one direction;

a charger for charging the surface of the photoconductor;

a light source for illuminating the original;

an optical system for guiding the light reflected by the original to the surface of the photoconductor to thereby form an electrostatic latent image;

a developing unit for developing the electrostatic latent image formed on the surface of the photoconductor to thereby form a toner image;

said charger being arranged to transfer the toner image formed on the surface of the photoconductor onto the copy paper;

a fixing unit for fixing the toner image transferred on the copy paper;

a casing in which the photoconductor, charger, light source, optical system, developing unit and fixing unit are arranged;

said photoconductor, light source, developing unit and fixing unit being arranged in substantially axial alignment with each other;

the size of said casing being substantially regulated by the size of the developing unit and the fixing unit; and a means for stretching the endless-belt shape photoconductor between the developing unit and the fixing unit so that the stretched photoconductor is of less height in a vertical direction than said units.

2. The electrophotographic copying apparatus as defined in claim 1, further comprising:

a cleaning member provided around the photoconductor and immediately downstream of the developing unit in the direction of movement of the photoconductor for cleaning residual toner on the surface of the photoconductor after the toner image is transferred by the charger.

3. The electrophotographic copying apparatus as defined in claim 2, wherein the cleaning member is incorporatively disposed with the developing unit.

4. The electrophotographic copying apparatus as defined in claim 2, wherein the cleaning member is movable toward and away from the surface of the photoconductor.

5. The electrophotographic copying apparatus as defined in claim 1, wherein the light source is positioned between the photoconductor and the fixing unit.

6. The electrophotographic copying apparatus as defined in claim 1, wherein the optical system is positioned between the photoconductor and the upper surface of the casing.

7. The electrophotographic copying apparatus as defined in claim 1, wherein the light source is also arranged to erase electric charge remaining on the surface of the photoconductor after the toner image is transferred by the charger.

8. The electrophotographic copying apparatus as defined in claim 1, wherein the fixing unit includes a pair of fixing rollers.

9. The electrophotographic copying apparatus as defined in claim 1, further comprising a means for moving the original along the upper surface of the casing for scanning.

10. An electrophotographic copying apparatus for copying an image of an original on a copy paper, comprising:

a casing substantially box shaped, and long and narrow in section;

an endless-belt shape photoconductor flatly stretched in the casing along the longitudinal direction of said section of the casing;

a developing unit provided on one side in the longitudinal direction in the casing for forming a toner image by developing an electrostatic latent image formed on the surface of the photoconductor;

a fixing unit provided on the other side in the longitudinal direction in the casing for fixing the toner image transferred on the copy paper, wherein the height of the casing is substantially regulated by the heights of the developing unit and the fixing unit, the endless-belt shape photoconductor is stretched between the developing unit and the fixing unit, and the stretched photoconductor is of less height in a vertical direction than the developing unit and the fixing unit to thereby form spaces between the upper surface of the casing and also between the lower surface of the casing;

a light source provided between the photoconductor and the fixing unit for illuminating the original;

an optical member provided in the space between the photoconductor and the upper surface of the casing for guiding the light reflected by the original onto the photoconductor; and a charger provided in the space between the photoconductor and the lower surface of the casing for transferring the toner image on the photoconductor onto the copy paper.

11. The electrophotographic copying apparatus as defined in claim 10, further comprising: a cleaning member provided around the photoconductor and immediately downstream of the developing unit in the direction of movement of the photoconductor for cleaning residual toner on the surface of the photoconductor after the toner image is transferred by the charger.

12. The electrophotographic copying apparatus as defined in claim 11, wherein the cleaning member is incorporatively disposed with the developing unit.

13. The electrophotographic copying apparatus as defined in claim 11, wherein the cleaning member is movable toward and away from the surface of the photoconductor.

14. The electrophotographic copying apparatus as defined in claim 10, wherein the light source is also arranged to erase electric charge remaining on the surface of the photoconductor after the toner image is transferred by the charger.

15. The electrophotographic copying apparatus as defined in claim 10, further comprising a table movably provided on the casing for holding the original thereon.

16. The electrophotographic copying apparatus as defined in claim 10, wherein the fixing unit includes a pair of fixing rollers.

17. An electrophotographic copying apparatus for copying an image of an original on a copy paper, comprising:

a substantially box-shaped casing;

moving means for moving the original along the upper surface of the casing for scanning;

an endless-belt photoconductor provided in the casing;

a developing unit which develops an electrostatic latent image formed on the photoconductor to thereby form a toner image;

a fixing unit which fixes the toner image transferred on the copy paper;

a light source which illuminates the original;

stretching means for stretching the photoconductor;

an optical member, positioned between the photoconductor and the upper surface of the casing, to guide the light reflected by the original onto the photoconductor for forming the electrostatic latent image and a charger, positioned between the photoconductor and the lower surface of the casing, which charges the photoconductor and also transfers the toner image on the photoconductor onto the copy paper, wherein said photoconductor, developing unit, fixing unit and light source are arranged in substantially axial alignment with each other within the casing.

18. The electrophotographic copying apparatus as defined in claim 17, wherein said moving means includes a table which is movably provided on the casing for holding the original thereon.

19. The electrophotographic copying apparatus as defined in claim 17, wherein the light source is positioned between the photoconductor and the fixing unit.

20. The electrophotographic copying apparatus as defined in claim 17, wherein the light source is also arranged to erase electric charge remaining on the photoconductor after the toner image is transferred by the charger.

21. An electrophotographic copying apparatus for copying an image of an original on a copy paper, comprising:

a substantially box-shaped casing;

moving means for moving the original along the upper surface of the casing for scanning;

an endless-belt photoconductor provided in the casing;

a developing unit which develops an electrostatic latent image formed on the photoconductor to thereby form a toner image;

a fixing unit which fixes the toner image transferred on the copy paper;

a light source which illuminates the original;

stretching means for stretching the photoconductor;

an optical member, positioned between the photoconductor and the upper surface of the casing, to guide the light reflected by the original onto the photoconductor for forming the electrostatic latent image;

a charger, positioned between the photoconductor and the lower surface of the casing, to charge the photoconductor and transfer the toner image on the photoconductor onto the copy paper;

a paper feed inlet through which the copy paper is manually inserted into the casing; and transporting means for transporting the copy paper along the lower surface of the casing from the paper feed inlet toward the charger, wherein said photoconductor, developing unit, fixing unit and light source are arranged in substantially axial alignment with each other within the casing.

22. The electrophotographic copying apparatus as defined in claim 21, wherein said moving means includes a table which is movably provided on the casing for holding the original thereon.

23. The electrophotographic copying apparatus as defined in claim 21, wherein said paper feed inlet is positioned below the developing unit, and the copy paper passes under the developing unit.

24. The electrophotographic copying apparatus as defined in claim 21, wherein the light source is positioned between the photoconductor and the fixing unit.

25. The electrophotographic copying apparatus as defined in claim 21, wherein the light source is also arranged to erase electric charge remaining on the photoconductor after the toner image is transferred by the charger.

* * * * *